US007879162B2

(12) United States Patent
Pandey

(10) Patent No.: US 7,879,162 B2
(45) **Date of Patent: *Feb. 1, 2011**

(54) HIGH STRENGTH ALUMINUM ALLOYS WITH $L1_2$ PRECIPITATES

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 12 days.

This patent is subject to a terminal disclaimer.

(21) Appl. No.: 12/148,426

(22) Filed: Apr. 18, 2008

(65) Prior Publication Data

US 2009/0263276 A1 Oct. 22, 2009

(51) Int. Cl.

| | |
|---|---|
| ***C22C 21/06*** | (2006.01) |
| *C22C 21/16* | (2006.01) |
| *C21D 8/02* | (2006.01) |
| *C22F 1/04* | (2006.01) |

(52) U.S. Cl. ..... 148/439; 148/417; 148/418; 148/542; 148/552; 420/542; 420/543

(58) Field of Classification Search ..... 148/439, 148/550, 542, 552; 420/542, 543
See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |

(Continued)

FOREIGN PATENT DOCUMENTS

| | | | |
|---|---|---|---|
| CN | 1436870 | A | 8/2003 |

(Continued)

OTHER PUBLICATIONS

Riddle Y.W. et al. "Improving recrystallization resistance in wrought aluminum alloys with scandium addition" Lightweight Alloys for Aerospace Application, Proceedings of [a] Symposium held at the TMS Annual Meeting, New Orleans, LA, U.S., Feb. 12-14, 2001. pp. 26-39. XP009117292.

(Continued)

*Primary Examiner*—Jessica L Ward
*Assistant Examiner*—Alexander Polyansky
(74) *Attorney, Agent, or Firm*—Kinney & Lange, P.A.

(57) ABSTRACT

High strength aluminum magnesium alloys that can be used at temperatures from about −420° F. (−251° C.) up to about 650° F. (343° C.) are described. The alloys are strengthened by dispersion of particles based on the $L1_2$ intermetallic compound $Al_3X$. These alloys comprise aluminum, magnesium, at least one of scandium, erbium, thulium, ytterbium, and lutetium; and at least one of gadolinium, yttrium, zirconium, titanium, hafnium, and niobium. These alloys may also optionally contain zinc, copper, lithium and silicon.

10 Claims, 6 Drawing Sheets

U.S. PATENT DOCUMENTS

| | | | | |
|---|---|---|---|---|
| 4,689,090 | A | | 8/1987 | Sawtell et al. |
| 4,710,246 | A | | 12/1987 | Le Caer et al. |
| 4,713,216 | A | | 12/1987 | Higashi et al. |
| 4,755,221 | A | | 7/1988 | Paliwal et al. |
| 4,853,178 | A | | 8/1989 | Oslin |
| 4,865,806 | A | | 9/1989 | Skibo et al. |
| 4,874,440 | A | | 10/1989 | Sawtell et al. |
| 4,915,605 | A | | 4/1990 | Chan et al. |
| 4,927,470 | A | | 5/1990 | Cho |
| 4,933,140 | A | | 6/1990 | Oslin |
| 4,946,517 | A | | 8/1990 | Cho |
| 4,964,927 | A | | 10/1990 | Shiflet et al. |
| 4,988,464 | A | | 1/1991 | Riley |
| 5,032,352 | A | | 7/1991 | Meeks et al. |
| 5,053,084 | A | | 10/1991 | Masumoto et al. |
| 5,055,257 | A | * | 10/1991 | Chakrabarti et al. ..... 148/564 |
| 5,059,390 | A | | 10/1991 | Burleigh et al. |
| 5,066,342 | A | | 11/1991 | Rioja et al. |
| 5,076,340 | A | | 12/1991 | Bruski et al. |
| 5,076,865 | A | | 12/1991 | Hashimoto et al. |
| 5,130,209 | A | | 7/1992 | Das et al. |
| 5,133,931 | A | | 7/1992 | Cho |
| 5,198,045 | A | | 3/1993 | Cho et al. |
| 5,211,910 | A | | 5/1993 | Pickens et al. |
| 5,226,983 | A | | 7/1993 | Skinner et al. |
| 5,256,215 | A | | 10/1993 | Horimura |
| 5,308,410 | A | | 5/1994 | Horimura et al. |
| 5,312,494 | A | | 5/1994 | Horimura et al. |
| 5,318,641 | A | | 6/1994 | Masumoto et al. |
| 5,397,403 | A | | 3/1995 | Horimura et al. |
| 5,458,700 | A | | 10/1995 | Masumoto et al. |
| 5,462,712 | A | | 10/1995 | Langan et al. |
| 5,480,470 | A | | 1/1996 | Miller et al. |
| 5,597,529 | A | | 1/1997 | Tack |
| 5,620,652 | A | | 4/1997 | Tack et al. |
| 5,624,632 | A | | 4/1997 | Baumann et al. |
| 5,882,449 | A | | 3/1999 | Waldron et al. |
| 6,139,653 | A | | 10/2000 | Fernandes et al. |
| 6,149,737 | A | | 11/2000 | Hattori et al. |
| 6,248,453 | B1 | | 6/2001 | Watson |
| 6,254,704 | B1 | | 7/2001 | Laul et al. |
| 6,258,318 | B1 | | 7/2001 | Lenczowski et al. |
| 6,309,594 | B1 | | 10/2001 | Meeks, III et al. |
| 6,312,643 | B1 | | 11/2001 | Upadhya et al. |
| 6,315,948 | B1 | | 11/2001 | Lenczowski et al. |
| 6,331,218 | B1 | | 12/2001 | Inoue et al. |
| 6,355,209 | B1 | | 3/2002 | Dilmore et al. |
| 6,368,427 | B1 | | 4/2002 | Sigworth |
| 6,506,503 | B1 | | 1/2003 | Mergen et al. |
| 6,517,954 | B1 | | 2/2003 | Mergen et al. |
| 6,524,410 | B1 | | 2/2003 | Kramer et al. |
| 6,531,004 | B1 | | 3/2003 | Lenczowski et al. |
| 6,562,154 | B1 | | 5/2003 | Rioja et al. |
| 6,630,008 | B1 | | 10/2003 | Meeks, III et al. |
| 6,702,982 | B1 | | 3/2004 | Chin et al. |
| 6,902,699 | B2 | | 6/2005 | Fritzemeier et al. |
| 6,918,970 | B2 | | 7/2005 | Lee et al. |
| 6,974,510 | B2 | | 12/2005 | Watson |
| 7,048,815 | B2 | | 5/2006 | Senkov et al. |
| 7,097,807 | B1 | | 8/2006 | Meeks, III et al. |
| 7,241,328 | B2 | | 7/2007 | Keener |
| 7,344,675 | B2 | | 3/2008 | Van Daam et al. |
| 2001/0054247 | A1 | | 12/2001 | Stall et al. |
| 2003/0192627 | A1 | | 10/2003 | Lee et al. |
| 2004/0046402 | A1 | | 3/2004 | Winardi |
| 2004/0055671 | A1 | | 3/2004 | Olson et al. |
| 2004/0089382 | A1 | | 5/2004 | Senkov et al. |
| 2004/0170522 | A1 | | 9/2004 | Watson |
| 2004/0191111 | A1 | | 9/2004 | Nie et al. |
| 2005/0147520 | A1 | | 7/2005 | Canzona |
| 2006/0011272 | A1 | | 1/2006 | Lin et al. |
| 2006/0093512 | A1 | | 5/2006 | Pandey |
| 2006/0172073 | A1 | | 8/2006 | Groza et al. |
| 2006/0269437 | A1 | | 11/2006 | Pandey |
| 2007/0048167 | A1 | | 3/2007 | Yano |
| 2007/0062669 | A1 | | 3/2007 | Song et al. |
| 2008/0066833 | A1 | | 3/2008 | Lin et al. |

FOREIGN PATENT DOCUMENTS

| | | | |
|---|---|---|---|
| CN | 101205578 | A | 6/2008 |
| EP | 0 208 631 | A1 | 6/1986 |
| EP | 0 584 596 | A2 | 3/1995 |
| EP | 1 111 079 | A1 | 12/1999 |
| EP | 1 111 078 | A2 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 728 881 | A2 | 12/2006 |
| EP | 1 788 102 | A1 | 5/2007 |
| FR | 2 656 629 | A1 | 12/1990 |
| FR | 2843754 | A1 | 2/2004 |
| JP | 04218638 | A | 12/1990 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2007188878 | A | 7/2007 |
| RU | 2001144 | C1 | 10/1993 |
| RU | 2001145 | A1 | 10/1993 |
| WO | 90 02620 | A1 | 3/1990 |
| WO | 91 10755 | A2 | 1/1991 |
| WO | 9111540 | A1 | 8/1991 |
| WO | WO 95 32074 | A2 | 11/1995 |
| WO | WO 96/10099 | | 4/1996 |
| WO | 9833947 | A1 | 8/1998 |
| WO | 00 37696 | A1 | 6/2000 |
| WO | 02 29139 | A2 | 4/2002 |
| WO | 03 052154 | A1 | 6/2003 |
| WO | WO 03 085145 | A2 | 10/2003 |
| WO | WO 03 085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2005045080 | A1 | 5/2005 |
| WO | 2005047554 | A1 | 5/2005 |

OTHER PUBLICATIONS

Lotsko D.V. et al. "Effect of small additions of transition metals on the structure of Al-Zn-Mg-Zr-Sc alloys" Advances in Insect Physiology, Academic Press, vol. 2, Nov. 4, 2002. pp. 535-536. XP009120838.

Mil'Man Yu V. et al. "Effect of additional alloying with transition metals on teh structure of an A1-7.1 Zn-1.3 Mg-0.12 Zr alloy" Metallofizika I Novej IE Technologii: Mi Narodnyj Naukovo-Technienyj Urnal, Nacional' Na Akademija Nauk Ukrainy, Instytut Metalofizyky, Kiev, vol. 26, No. 10. Jan. 1, 2004. pp. 1363-1378. XP009117293.

Riddle Y.W. et al. "A study of coarsening, recrystallization, and morphology of microstructure in Al-Sc-(Zr)-(Mg) alloys" Metallurgical and Materials Transactions A: Physical Metallurgy & Materials Science, ASM International, Materials Park, OH, U.S., vol. 35A, No. 1, Jan. 1, 2004. pp. 341-350. XP002528950.

Litynska et al. "Experimental and theoretical characterization of AL3Sc precipitates in Al-Mg-Si-Cu-Sc-Zr alloys" Zeitschrift Fur Metallkunde, Carl Hanser, Munich, DE, vol. 97, No. 3. Jan. 1, 2006. pp. 321-324. XP 009120841.

Pandey A.B. et al. "High strength discontinuously reinforced aluminum for rocket applications" Affordable Metal Matrix Composites for High Performance Application. Symposia Proceedings, TMS (The Minerals, Metals & Materials Society), U.S., No. 2nd. Jan. 1, 2008. pp. 3-12. XP009081072.

The Official Search Report of the European Patent Office in Counterpart Foreign Application No. EP 09 25 0983 filed Mar. 31, 2009.

Cook, R., et al. "Aluminum and Aluminum Alloy Powders for P/M Applications." The Aluminum Powder Company Limited, Ceracon Inc. .

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of AI3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Tian, N. et al. "Heating rate dependence of glass transition and primary crystallization of AI88Gd6Er2Ni4 metallic glass." Scripta Materialia 53 (2005) pp. 681-685.

Rachek, O.P. "X-ray diffraction study of amorphous alloys Al-Ni-Ce-Sc with using Ehrenfest's formula." Journal of Non-Crystalline Solids 352 (2006) pp. 3781-3786.

Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.

Riddle, Y.W., et al. "Recrystallization Performance of AA7050 Varied with Sc and Zr." Materials Science Forum. 2000. pp. 799-804.

Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.

Hardness Conversion Table. Downloaded from http://www.gordonengland.co.uk/hardness/hardness_conversion_2m.htm.

* cited by examiner

HIGH STRENGTH ALUMINUM ALLOYS WITH $L1_2$ PRECIPITATES

CROSS-REFERENCE TO RELATED APPLICATIONS

This application is related to the following co-pending applications that are filed on even date herewith and are assigned to the same assignee: $L1_2$ ALUMINUM ALLOYS WITH BIMODAL AND TRIMODAL DISTRIBUTION, Ser. No. 12/148,395; DISPERSION STRENGTHENED $L1_2$ ALUMINUM ALLOYS, Ser. No. 12/148,432; HEAT TREATABLE $L1_2$ ALUMINUM ALLOYS, Ser. No. 12/148,383; HIGH STRENGTH $L1_2$ ALUMINUM ALLOYS, Ser. No. 12/148,394; HIGH STRENGTH $L1_2$ ALUMINUM ALLOYS, Ser. No. 12/148,382; HEAT TREATABLE $L1_2$ ALUMINUM ALLOYS, Ser. No. 12/148,396; HIGH STRENGTH $L1_2$ ALUMINUM ALLOYS, Ser. No. 12/148,387; HIGH STRENGTH $L1_2$ ALUMINUM ALLOYS, Ser. No. 12/148,459; and $L1_2$ STRENGTHENED AMORPHOUS ALUMINUM ALLOYS, Ser. No. 12/148,458.

BACKGROUND

The present invention relates generally to aluminum alloys and more specifically to heat treatable aluminum alloys strengthened by $L1_2$ phase dispersions that are useful at temperatures from about −420° F. (−251° C.) up to about 650° F. (343° C.).

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and U. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). U.S. Patent Application Publication No. 2006/0093512 by the current inventor discloses an aluminum magnesium alloy strengthened with a dispersion of $Al_3X$ dispersoids with the $L1_2$ structure where X comprises Sc, Gd, and Zr. The alloy provides excellent mechanical properties in the temperature range of about −420° F. (−250° C.) up to about 573° F. (300° C.).

An aluminum magnesium alloy strengthened by $L1_2$ precipitates with excellent mechanical properties in the temperature range of about 420° F. (−250° C.) to about 650° F. (343° C.) would be useful.

SUMMARY

The present invention is an aluminum magnesium alloy that is strengthened with $L1_2$ dispersoids. The alloys have mechanical properties suitable for application at temperature ranges from about −420° F. (−251° C.) to about 650° F. (343° C.). The alloys comprise magnesium, coherent $Al_3Sc$ $L1_2$ dispersoids, and coherent $Al_3X$ $L1_2$ dispersoids where X is at least one element selected from scandium, erbium, thulium, ytterbium, and lutetium, and at least one element selected from gadolinium, yttrium, zirconium, titanium, hafnium, and niobium. The balance is substantially aluminum.

The alloys can also contain one or more elements selected from zinc, copper, lithium and silicon.

The alloys have less than about 1 weight percent total impurities.

The alloys can be formed by any rapid solidification technique that includes atomization, melt spinning, splat quenching, spray deposition, cold spray, plasma spray, laser melting, ball milling, and cryomilling. The alloys with smaller amounts of alloying elements can also be formed by casting and deformation processing.

The alloys can be heat treated at a temperature of about 800° F. (426° C.) to about 1100° F. (593° C.) for about 30 minutes to about four hours, followed by quenching in liquid and thereafter aged at a temperature of about 200° F. (93° C.) to about 600° F. (315° C.) for about two to about forty-eight hours.

DETAILED DESCRIPTION

The alloys of this invention are based on the aluminum magnesium system. The amount of magnesium in these alloys ranges from about 1 to about 8 weight percent, more preferably about 3 to about 7.5 weight percent, and even more preferably about 4 to about 6.5 weight percent.

Figure 1:
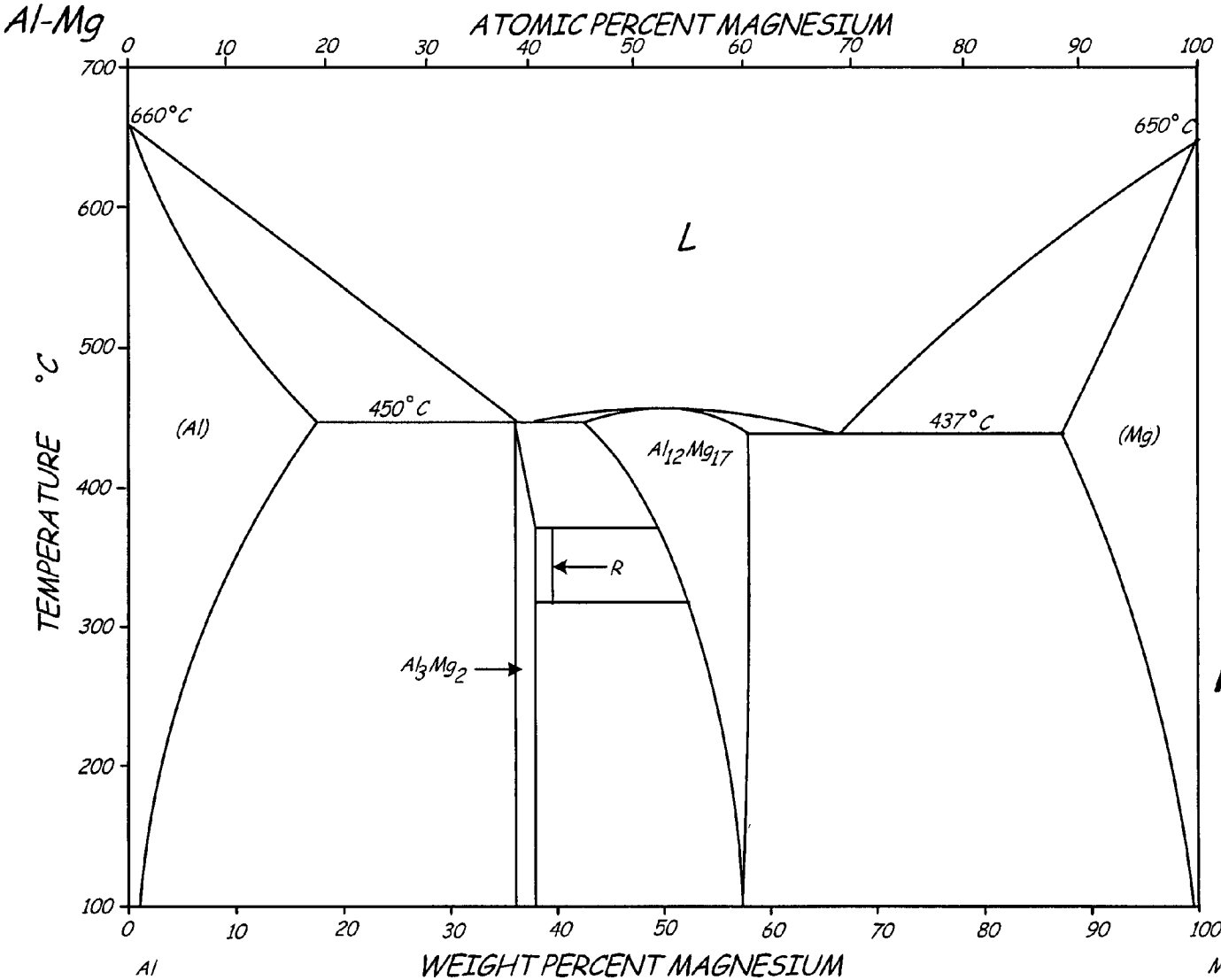
FIG. 1 is an aluminum magnesium phase diagram.

The aluminum magnesium phase diagram is shown in FIG. 1. The binary system is a eutectic alloy system with a eutectic reaction at 36 weight percent magnesium and 842° F. (450° C.). Magnesium has its maximum solid solubility of 16 weight percent in aluminum at 842° F. (450° C.) which can be extended further by rapid solidification processing. Magnesium provides substantial solid solution of strengthening in aluminum.

The alloys may also optionally contain at least one element selected from zinc, copper, lithium and silicon to produce additional strengthening. The amount of zinc in these alloys ranges from about 3 to about 12 weight percent, more preferably about 4 to about 10 weight percent, and even more preferably about 5 to about 9 weight percent. The amount of copper in these alloys ranges from about 0.2 to about 3 weight percent, more preferably about 0.5 to about 2.5 weight percent, and even more preferably about 1 to about 2.5 weight percent. The amount of lithium in these alloys ranges from about 0.5 to about 3 weight percent, more preferably about 1 to about 2.5 weight percent, and even more preferably about 1 to about 2 weight percent. The amount of silicon in these alloys ranges from about 4 to about 25 weight percent silicon, more preferably about 4 to about 18 weight percent, and even more preferably about 5 to about 11 weight percent.

Exemplary aluminum alloys of this invention include, but are not limited to (in weight percent):

about Al-(1-8)Mg-(0.1-4)Sc-(0.1-20)Gd;
about Al-(1-8)Mg-(0.1-20)Er-(0.1-20)Gd;
about Al-(1-8)Mg-(0.1-15)Tm-(0.1-20)Gd;
about Al-(1-8)Mg-(0.1-25)Yb-(0.1-20)Gd;
about Al-(1-8)Mg-(0.1-25)Lu-(0.1-20)Gd;
about Al-(1-8)Mg-(0.1-4)Sc-(0.1-20)Y;
about Al-(1-8)Mg-(0.1-20)Er-(0.1-20)Y;
about Al-(1-8)Mg-(0.1-15)Tm-(0.1-20)Y;
about Al-(1-8)Mg-(0.1-25)Yb-(0.1-20)Y;
about Al-(1-8)Mg-(0.1-25)Lu-(0.1-20)Y;
about Al-(1-8Mg-(0.1-4)Sc-(0.05-3.0)Zr;
about Al-(1-8)Mg-(0.1-20)Er-(0.05-4.0)Zr;
about Al-(1-8)Mg-(0.1-15)Tm-(0.05-4.0)Zr;
about Al-(1-8)Mg-(0.1-25)Yb-(0.05-4.0)Zr;
about Al-(1-8)Mg-(0.1-25)Lu-(0.05-4.0)Zr;
about Al-(1-8)Mg-(0.1-4)Sc-(0.05-10)Ti;
about Al-(1-8)Mg-(0.1-20)Er-(0.05-10)Ti;
about Al-(1-8)Mg-(0.1-15)Tm-(0.05-10)Ti;
about Al-(1-8)Mg-(0.1-25)Yb-(0.05-10)Ti;
about Al-(1-8)Mg-(0.1-25)Lu-(0.05-10)Ti;
about Al-(1-8)Mg-(0.1-4)Sc-(0.05-10)Hf;
about Al-(1-8)Mg-(0.1-20)Er-(0.05-10)Hf;
about Al-(1-8)Mg-(0.1-15)Tm-(0.05-10)Hf;
about Al-(1-8)Mg-(0.1-25)Yb-(0.05-10)Hf;
about Al-(1-8)Mg-(0.1-25)Lu-(0.05-10)Hf;
about Al-(1-8)Mg-(0.1-4)Sc-(0.05-5)Nb;
about Al-(1-8)Mg-(0.1-20)Er-(0.05-5)Nb;
about Al-(1-8)Mg-(0.1-15)Tm-(0.05-5)Nb;
about Al-(1-8)Mg-(0.1-25)Yb-(0.05-5)Nb; and
about Al-(1-8)Mg-(0.1-25)Lu-(0.05-5)Nb.

In the inventive aluminum based alloys disclosed herein, scandium is a potent strengthener that has low diffusivity and low solubility in aluminum. Scandium forms equilibrium $Al_3Sc$ intermetallic dispersoids that have an $L1_2$ structure that is an ordered face centered cubic structure with Sc atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Addition of magnesium in solid solution in aluminum increases the lattice parameter of the aluminum matrix, and decreases the lattice parameter mismatch further increasing the resistance of the $Al_3Sc$ to coarsening. In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Er$ to coarsening. In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Tm$ to coarsening. In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Yb$ to coarsening. In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Lu$ to coarsening. In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that have an $L1_2$ structure in the metastable condition and a $D0_{19}$ structure in the equilibrium condition. The $Al_3Gd$ dispersoids are stable up to temperatures as high as about 842° F. (450° C.) due to their low diffusivity in aluminum. Despite its large atomic size, gadolinium has fairly high solubility in the $Al_3Sc$ intermetallic dispersoid.

Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ dispersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which results in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

Additions of zinc, copper, lithium and silicon increase the strength of these alloys through additional solid solution hardening and precipitation hardening of $Zn_2Mg$ (η'), $Al_2Cu$ (θ'), $Al_2CuMg$ (S'), $Al_3Li$ (δ'), $Al_2LiMg$, $Mg_2Si$ and Si phases, respectively. These phases precipitate as coherent fine particles which can provide considerable strengthening in the alloys. Precipitation of these phases can be controlled during heat treatment.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

Figure 2:
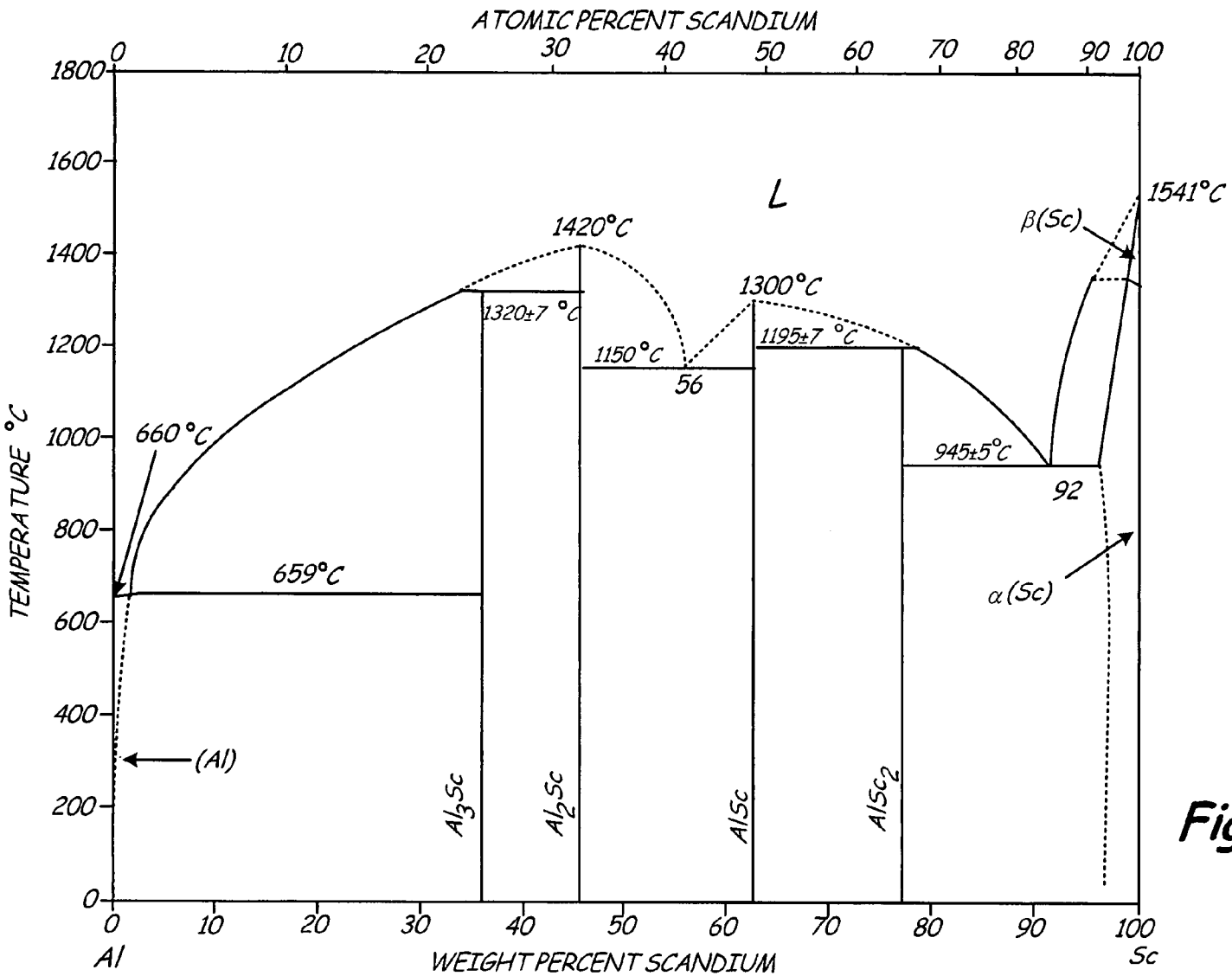
FIG. 2 is an aluminum scandium phase diagram.

The amount of scandium present in the alloys of this invention if any may vary from about 0.1 to about 4 weight percent, more preferably from about 0.1 to about 3 weight percent, and even more preferably from about 0.2 to about 2.5 weight percent. The Al—Sc phase diagram shown in FIG. 2 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second.

Figure 3:
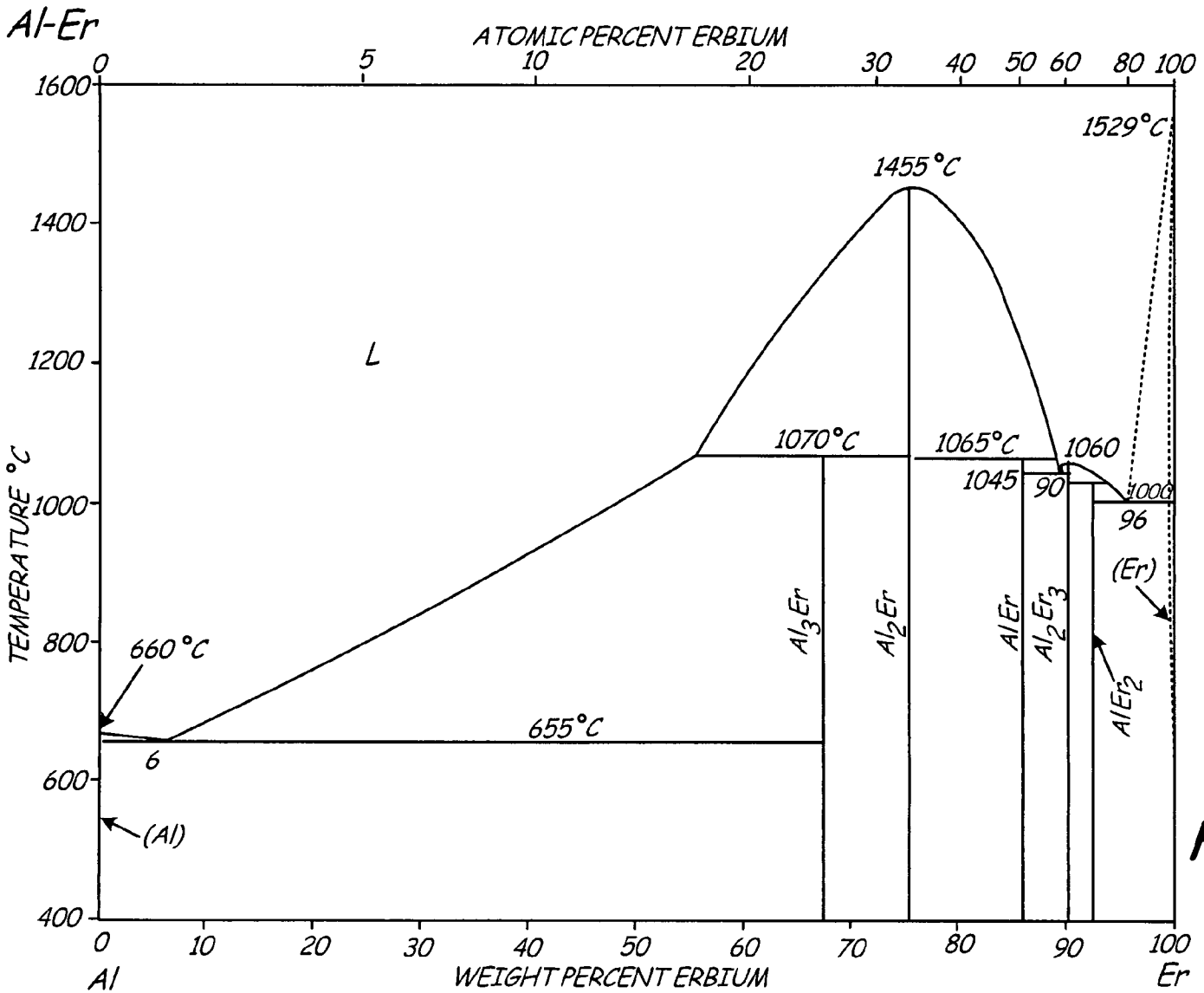
FIG. 3 is an aluminum erbium phase diagram.

The amount of erbium present in the alloys of this invention, if any, may vary from about 0.1 to about 20 weight percent, more preferably from about 0.3 to about 15 weight percent, and even more preferably from about 0.5 to about 10 weight percent. The Al—Er phase diagram shown in FIG. 3 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second. Alloys with erbium in excess of the eutectic composition (hypereutectic alloys) cooled normally will have a microstructure consisting of relatively large $Al_3Er$ dispersoids in a finely divided aluminum-$Al_3Er$ eutectic phase matrix.

Figure 4:
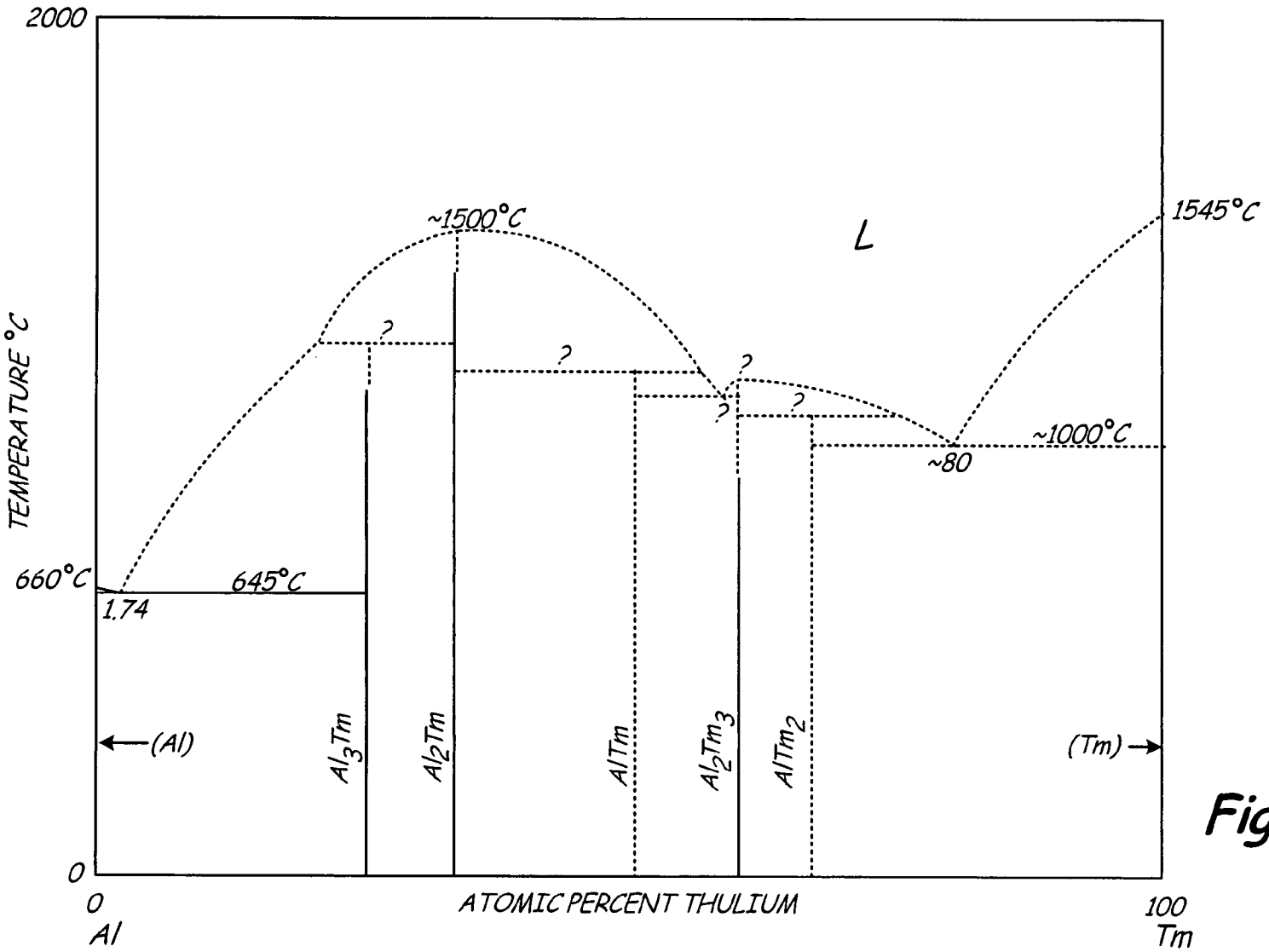
FIG. 4 is an aluminum thulium phase diagram.

The amount of thulium present in the alloys of this invention, if any, may vary from about 0.1 to about 15.0 weight percent, more preferably from about 0.2 to about 10 weight percent, and even more preferably from about 0.4 to about 6 weight percent. The Al—Tm phase diagram shown in FIG. 4 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 5:
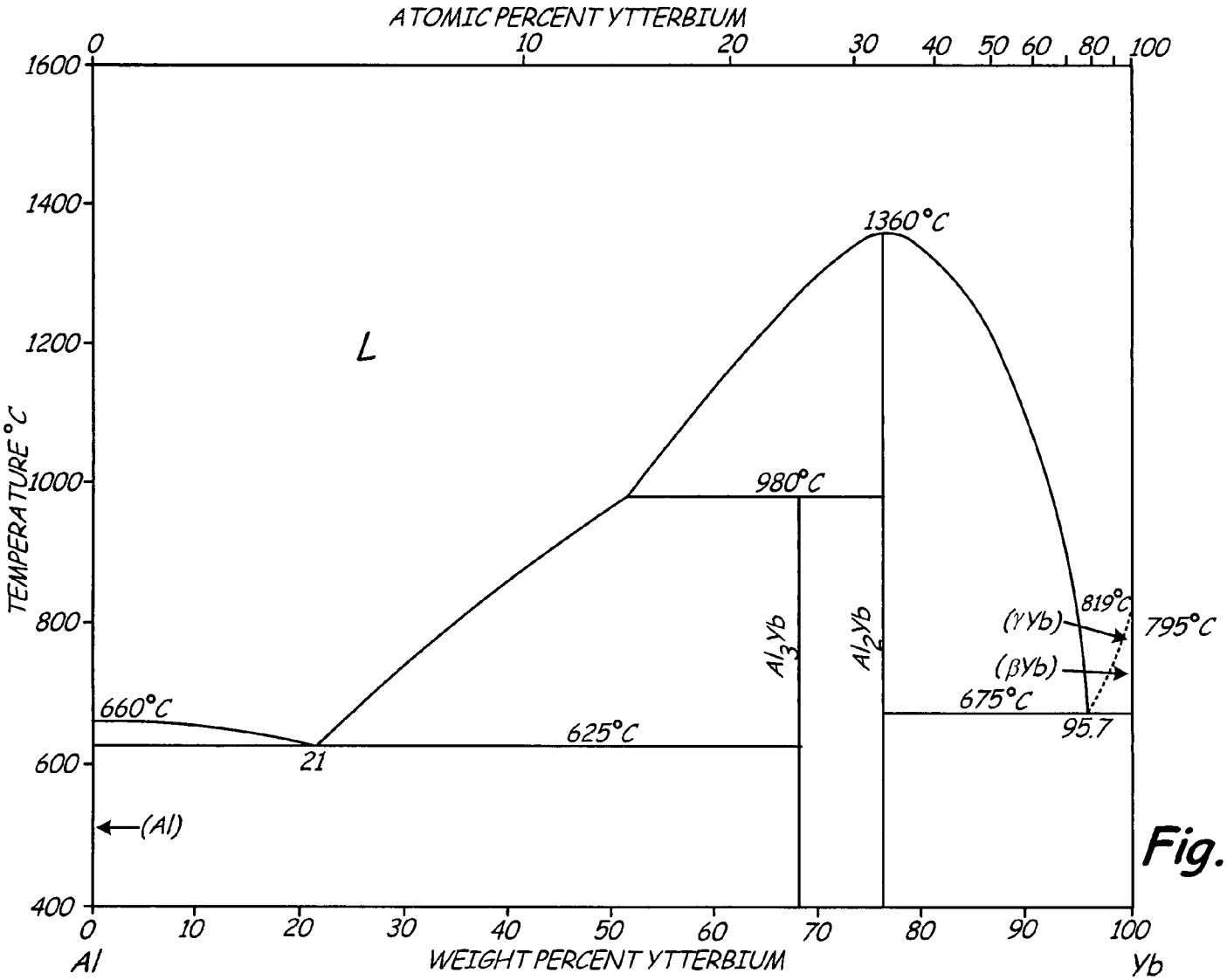
FIG. 5 is an aluminum ytterbium phase diagram.

The amount of ytterbium present in the alloys of this invention, if any, may vary from about 0.1 to about 25 weight percent, more preferably from about 0.3 to about 20 weight percent, and even more preferably from about 0.4 to about 10 weight percent. The Al—Yb phase diagram shown in FIG. 5 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C./second.

Figure 6:
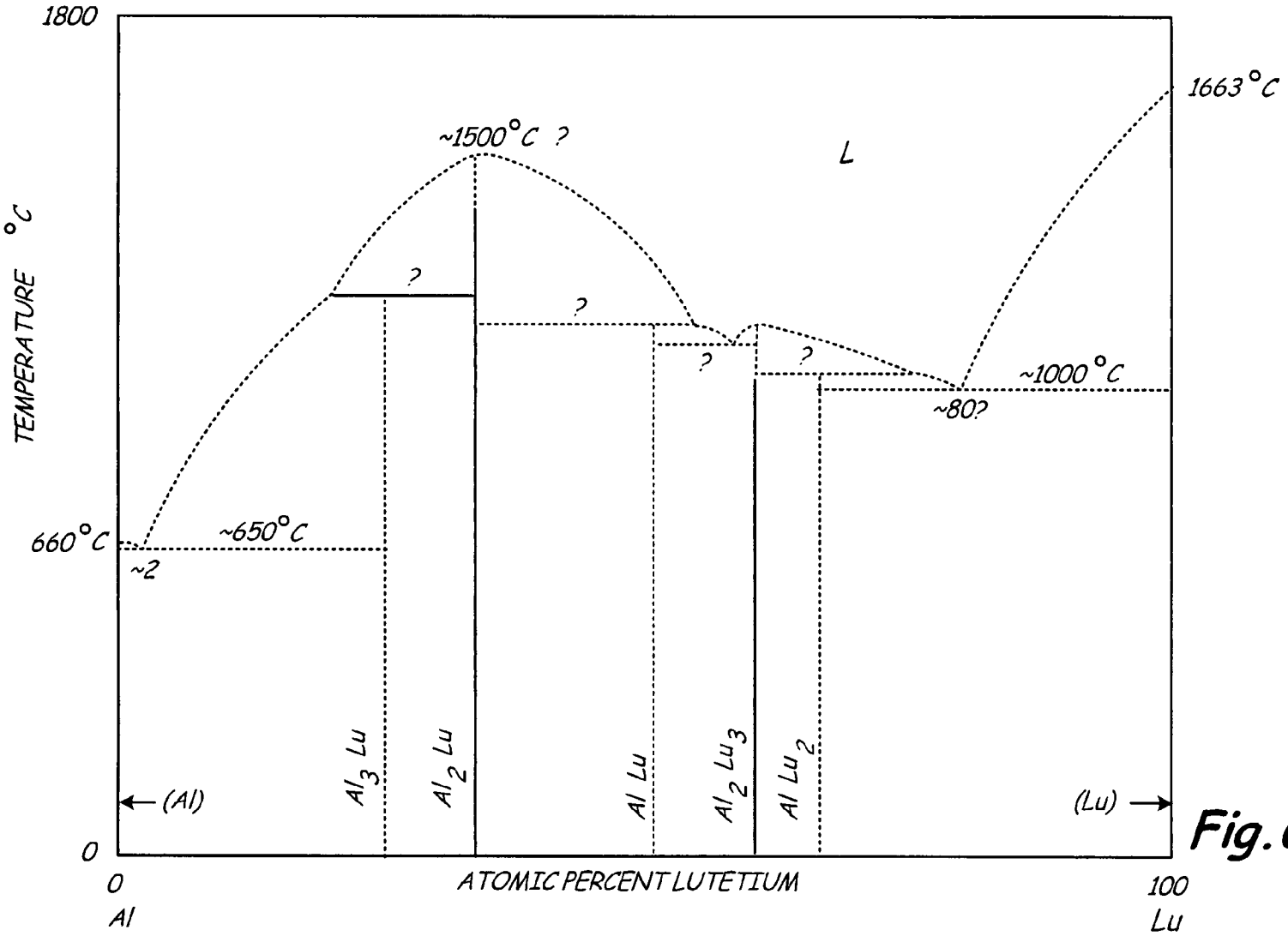
FIG. 6 is an aluminum lutetium phase diagram.

The amount of lutetium present in the alloys of this invention, if any, may vary from about 0.1 to about 25 weight percent, more preferably from about 0.3 to about 20 weight percent, and even more preferably from about 0.4 to about 10 weight percent. The Al—Lu phase diagram shown in FIG. 6 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys of this invention, if any, may vary from about 0.1 to about 20 weight percent, more preferably from about 0.3 to about 15 weight percent, and even more preferably from about 0.5 to about 10 weight percent.

The amount of yttrium present in the alloys of this invention, if any, may vary from about 0.1 to about 20 weight percent, more preferably from about 0.3 to about 15 weight percent, and even more preferably from about 0.5 to about 10 weight percent.

The amount of zirconium present in the alloys of this invention, if any, may vary from about 0.05 to about 4 weight percent, more preferably from about 0.1 to about 3 weight percent, and even more preferably from about 0.3 to about 2 weight percent.

The amount of titanium present in the alloys of this invention, if any, may vary from about 0.05 to about 10 weight percent, more preferably from about 0.2 to about 8 weight percent, and even more preferably from about 0.4 to about 4 weight percent.

The amount of hafnium present in the alloys of this invention, if any, may vary from about 0.05 to about 10 weight percent, more preferably from about 0.2 to about 8 weight percent, and even more preferably from about 0.4 to about 5 weight percent.

The amount of niobium present in the alloys of this invention, if any, may vary from about 0.05 to about 5 weight percent, more preferably from about 0.1 to about 3 weight percent, and even more preferably from about 0.2 to about 2 weight percent.

In order to have the best properties for the alloys of this invention, it is desirable to limit the amount of other elements. Specific elements that should be reduced or eliminated include no more than about 0.1 weight percent iron, 0.1 weight percent chromium, 0.1 weight percent manganese, 0.1 weight percent vanadium, 0.1 weight percent cobalt, and 0.1 weight percent nickel. The total quantity of additional elements should not exceed about 1% by weight, including the above listed elements.

The alloy of the present invention can be processed by any rapid solidification technique utilizing cooling rates in excess of $10^{3}$° C./second. The rapid solidification process includes melt spinning, splat quenching, atomization, spray deposition, cold spray, vacuum plasma spray, and laser melting. The particular processing technique is not important. The most important aspect is the cooling rate of the process. A higher cooling rate is required for the alloys with larger amount of solute additions. These processes produce different forms of the product such as ribbon, flake or powder. Atomization is the most commonly used rapid solidification technique to produce a large volume of powder. Cooling rate experienced during atomization depends on the powder size and usually varies from about $10^{3}$ to $10^{5}$° C./second. Finer size (−325 mesh) of powder is preferred to have maximum supersaturation of alloying elements that can precipitate out during extrusion of powder. For higher supersaturation of alloying elements, helium gas atomization is preferred. Helium gas provides higher heat transfer coefficient leading to higher cooling rate in the powder. The ribbon or powder of alloy can be compacted using vacuum hot pressing, hot isostatic pressing or blind die compaction after suitable vacuum degassing. Compaction takes place by shear deformation in vacuum hot pressing and blind die compaction, whereas diffusional creep is key for compaction in hot isostatic pressing.

The alloy powder of the present invention can also be produced using mechanical alloying or cryomilling where powder is milled using high energy ball milling at room temperature or at cryogenic temperature in liquid nitrogen environment. While both mechanical alloying and cryomilling processes can provide supersaturation of alloying elements, cryomilling is preferred because it has less oxygen content. Cryomilling introduces oxynitride particles in the grains that can provide additional strengthening to the alloy at high temperature by increasing threshold stress for dislocation climb. In addition, the nitride particles when located on grain boundaries can reduce the grain boundary sliding in the alloy by pinning the dislocation resulting in reduced dislocation mobility in the grain boundaries.

The alloy may also be produced using casting processes such as squeeze casting, die casting, sand casting and permanent mold casting provided the alloy contains small amounts of Sc, Er, Tm, Yb, Lu, Gd, Y, Ti, Hf, or Nb.

Following consolidation and deformation processing, the alloys can be heat treated at a temperature of from about 800° F. (426° C.) to about 1100° F. (593° C.) for about thirty minutes to four hours followed by quenching in liquid and thereafter aged at a temperature from about 200° F. (93° C.) to about 600° F. (316° C.) for about two to forty-eight hours.

More preferred exemplary aluminum alloys of this invention include, but are not limited to (in weight percent):

about Al-(3-7.5)Mg-(0.1-3)Sc-(0.3-15)Gd;
about Al-(3-7.5)Mg-(0.3-15)Er-(0.3-15)Gd;
about Al-(3-7.5)Mg-(0.2-10)Tm-(0.3-15)Gd;
about Al-(3-7.5)Mg-(0.3-20)Yb-(0.3-15)Gd;
about Al-(3-7.5)Mg-(0.3-20)Lu-(0.3-15)Gd;
about Al-(3-7.5)Mg-(0.1-3)Sc-(0.3-15)Y;
about Al-(3-7.5)Mg-(0.3-15)Er-(0.3-15)Y;
about Al-(3-7.5)Mg-(0.2-10)Tm-(0.3-15)Y;
about Al-(3-7.5)Mg-(0.3-20)Yb-(0.3-15)Y;
about Al-(3-7.5)Mg-(0.3-20)Lu-(0.3-15)Y;
about Al-(3-7.5)Mg-(0.1-3)Sc-(0.1-3)Zr;
about Al-(3-7.5)Mg-(0.3-15)Er-(0.1-3)Zr;
about Al-(3-7.5)Mg-(0.2-10)Tm-(0.1-3)Zr;
about Al-(3-7.5)Mg-(0.3-20)Yb-(0.1-3)Zr;
about Al-(3-7.5)Mg-(0.3-20)Lu-(0.1-3)Zr;
about Al-(3-7.5)Mg-(0.1-3)Sc-(0.2-8)Ti;

about Al-(3-7.5)Mg-(0.3-15)Er-(0.2-8)Ti;
about Al-(3-7.5)Mg-(0.2-10)Tm-(0.2-8)Ti;
about Al-(3-7.5)Mg-(0.3-20)Yb-(0.2-8)Ti;
about Al-(3-7.5)Mg-(0.3-20)Lu-(0.2-8)Ti;
about Al-(3-7.5)Mg-(0.1-3)Sc-(0.2-8)Hf;
about Al-(3-7.5)Mg-(0.3-15)Er-(0.2-8)Hf;
about Al-(3-7.5)Mg-(0.2-10)Tm-(0.2-8)Hf;
about Al-(3-7.5)Mg-(0.3-20)Yb-(0.2-8)Hf;
about Al-(3-7.5)Mg-(0.3-20)Lu-(0.2-8)Hf;
about Al-(3-7.5)Mg-(0.1-3)Sc-(0.1-3)Nb;
about Al-(3-7.5)Mg-(0.3-15)Er-(0.1-3)Nb;
about Al-(3-7.5)Mg-(0.2-10)Tm-(0.1-3)Nb;
about Al-(3-7.5)Mg-(0.3-20)Yb-(0.1-3)Nb; and
about Al-(3-7.5)Mg-(0.3-20)Lu-(0.1-3)Nb.

Even more preferred examples of similar alloys to these are alloys with about 4 to about 6.5 weight percent Mg. These exemplary alloys may also optionally contain at least one of the elements from zinc, copper, lithium and silicon to produce additional strengthening, and include, but are not limited to (in weight percent):

about Al-(4-6.5)Mg-(0.2-2.5)Sc-(0.5-10)Gd;
about Al-(4-6.5)Mg-(0.5-10)Er-(0.5-10)Gd;
about Al-(4-6.5)Mg-(0.4-6)Tm-(0.5-10)Gd;
about Al-(4-6.5)Mg-(0.4-10)Yb-(0.5-10)Gd;
about Al-(4-6.5)Mg-(0.4-10)Lu-(0.5-10)Gd;
about Al-(4-6.5)Mg-(0.2-2.5)Sc-(0.5-10)Y;
about Al-(4-6.5)Mg-(0.5-10)Er-(0.5-10)Y;
about Al-(4-6.5)Mg-(0.4-6)Tm-(0.5-10)Y;
about Al-(4-6.5)Mg-(0.4-10)Yb-(0.5-10)Y;
about Al-(4-6.5)Mg-(0.4-10)Lu-(0.5-10)Y;
about Al-(4-6.5)Mg-(0.2-2.5)Sc-(0.3-2)Zr;
about Al-(4-6.5)Mg-(0.5-10O)Er-(0.3-2)Zr;
about Al-(4-6.5)Mg-(0.4-6)Tm-(0.3-2)Zr;
about Al-(4-6.5)Mg-(0.4-10)Yb-(0.3-2)Zr;
about Al-(4-6.5)Mg-(0.4-10)Lu-(0.3-2)Zr;
about Al-(4-6.5)Mg-(0.2-2.5)Sc-(0.4-4)Ti;
about Al-(4-6.5)Mg-(0.5-10)Er-(0.4-4)Ti;
about Al-(4-6.5)Mg-(0.4-6)Tm-(0.4-4)Ti;
about Al-(4-6.5)Mg-(0.4-10)Yb-(0.4-4)Ti;
about Al-(4-6.5)Mg-(0.4-10)Lu-(0.4-4)Ti;
about Al-(4-6.5)Mg-(0.2-2.5)Sc-(0.4-5)Hf;
about Al-(4-6.5)Mg-(0.5-10)Er-(0.4-5)Hf;
about Al-(4-6.5)Mg-(0.4-6)Tm-(0.4-5)Hf;
about Al-(4-6.5)Mg-(0.4-10)Yb-(0.4-5)Hf;
about Al-(4-6.5)Mg-(0.4-10)Lu-(0.4-5)Hf;
about Al-(4-6.5)Mg-(0.2-2.5)Sc-(0.2-2)Nb;
about Al-(4-6.5)Mg-(0.5-10)Er-(0.2-2)Nb;
about Al-(4-6.5)Mg-(0.4-6)Tm-(0.2-2)Nb;
about Al-(4-6.5)Mg-(0.4-10)Yb-(0.2-2)Nb; and
about Al-(4-6.5)Mg-(0.4-10)Lu-(0.2-2)Nb.

Although the present invention has been described with reference to preferred embodiments, workers skilled in the art will recognize that changes may be made in form and detail without departing from the spirit and scope of the invention.

The invention claimed is:

1. A heat treatable aluminum alloy consisting of:

about 1 to about 8 weight percent magnesium;

at least one of about 3 to about 12 weight percent zinc; about 0.2 to about 3 weight percent copper; about 0.5 to about 3 weight percent lithium; about 4 to about 25 weight percent silicon;

at least one first element selected from the group consisting of about 0.1 to about 4 weight percent scandium; about 0.1 to about 20 weight percent erbium, about 0.1 to about 15 weight percent thulium, about 0.1 to about 25 weight percent ytterbium, and about 0.1 to about 25 weight percent lutetium;

at least one second element selected from the group consisting of about 0.1 to about 20 weight percent gadolinium, about 0.1 to about 20 weight percent yttrium, about 0.05 to about 4 weight percent zirconium, about 0.05 to about 10 weight percent titanium, about 0.05 to about 10 weight percent hafnium, and about 0.05 to about 5 weight percent niobium;

no more than about 1.0 weight percent total other elements including impurities;

no more than about 0.1 weight percent iron, about 0.1 weight percent chromium, about 0.1 weight percent manganese, about 0.1 weight percent vanadium, about 0.1 weight percent cobalt, and about 0.1 weight percent nickel;

and the balance substantially aluminum;

wherein the alloy is formed by rapid solidification processing at a cooling rate greater than about $10^{3}$° C./second, followed by heat treating by a solution anneal at a temperature of about 800° F. (426° C.) to about 1100° F. (593° C.) for about 30 minutes to four hours, followed by quenching, and is thereafter aged at a temperature of about 200° F. (93° C.) to about 600° F. (316° C.) for about two to forty-eight hours.

2. The alloy of claim 1, wherein the alloy has an aluminum solid solution matrix containing a plurality of dispersed $Al_3Sc$ second phases having $L1_2$ structures and $Al_3X$ second phases having $L1_2$ structures wherein X includes the at least one first element.

3. The alloy of claim 2, wherein the solid solution has an aluminum magnesium solid solution.

4. The alloy of claim 1, wherein the alloy is capable of being used at temperatures from about −420° F. (−251° C.) up to about 650° F. (343° C.).

5. The alloy of claim 1, wherein the alloy is produced by at least one of: a rapid solidification technique utilizing a cooling rate of at least about $10^{3}$° C./second, a casting process, and a deformation process.

6. The alloy of claim 5, wherein the rapid solidification technique comprises at least one of: melt spinning, splat quenching, atomization, spray deposition, vacuum plasma spraying, cold spraying, laser melting, mechanical alloying, cryomilling, spin forming, and ball milling.

7. The alloy of claim 5, wherein the casting process comprises at least one of squeeze casting, die casting, sand casting, and permanent mold casting.

8. The alloy of claim 5, wherein the deformation processing includes at least one of extrusion, forging and rolling.

9. The alloy of claim 5, wherein the alloy is heat treated after forming.

10. A heat treatable aluminum alloy consisting of:

about 1 to about 8 weight percent magnesium;

an aluminum solid solution matrix containing a plurality of dispersed $Al_3X$ second phases having $L1_2$ structures where X includes at least one first element selected from the group consisting of about 0.1 to about 4 weight percent scandium; about 0.1 to about 20 weight percent erbium, about 0.1 to about 15 weight percent thulium, about 0.1 to about 25 weight percent ytterbium, and about 0.1 to about 25 weight percent lutetium;

at least one second element selected from the group consisting of about 0.1 to about 20 weight percent gadolinium, about 0.1 to about 20 weight percent yttrium, about 0.05 to about 4 weight percent zirconium, about 0.05 to about 10 weight percent titanium, about 0.05 to about 10 weight percent hafnium, and about 0.05 to about 5 weight percent niobium; and the balance substantially aluminum;

wherein the alloy is formed by rapid solidification processing at a cooling rate greater than about $10^{3}$° C./second, followed by heat treating by a solution anneal at a temperature of about 800° F. (426° C.) to about 1100° F. (593° C.) for about 30 minutes to four hours, followed by quenching, and is thereafter aged at a temperature of about 200° F. (93° C.) to about 600° F. (316° C.) for about two to forty-eight hours.

* * * * *